US005288575A

United States Patent [19]

Kashizaki et al.

[11] Patent Number: 5,288,575

[45] Date of Patent: Feb. 22, 1994

[54] ELECTROPHOTOGRAPHIC PHOTOSENSITIVE MEMBER, AND ELECTROPHOTOGRAPHIC APPARATUS, DEVICE UNIT AND FACSIMILE MACHINE EMPLOYING THE PHOTOSENSITIVE MEMBER

[75] Inventors: Yoshio Kashizaki; Koichi Suzuki; Shintetsu Go; Satomi Sugiyama, all of Kanagawa, Japan

[73] Assignee: Canon Kabushiki Kaisha, Tokyo, Japan

[21] Appl. No.: 976,500

[22] Filed: Nov. 13, 1992

[30] Foreign Application Priority Data

Nov. 14, 1991 [JP] Japan ..... 3-325113

[51] Int. Cl.[5] ..... G03G 5/04

[52] U.S. Cl. ..... 430/58; 430/96; 358/296

[58] Field of Search ..... 430/58, 59, 96

[56] References Cited

U.S. PATENT DOCUMENTS 3,839,033 10/1974 Matsumo et al. ..... 96/1.5
5,063,130 11/1991 Kato et al. ..... 430/96

FOREIGN PATENT DOCUMENTS 62-30254 2/1987 Japan .
62-95537 5/1987 Japan .

*Primary Examiner*—John Goodrow
*Attorney, Agent, or Firm*—Fitzpatrick, Cella, Harper & Scinto

[57] ABSTRACT

An electrophotographic photosensitive member has an electroconductive substrate and a photosensitive layer formed thereon. The photosensitive layer contains an acetal resin having a component unit represented by the following formula (1):

(1)

wherein X is $R_1$ is a substituted or unsubstituted aryl group and a substituted or unsubstituted heterocyclic group; $R_2$ is a hydrogen atom and a substituted or unsubstituted alkyl group; $R_3$ is a substituted or unsubstituted alkyl group; A is a substituted or unsubstituted heterocyclic group and $R_4$ is a substituted or unsubstituted heterocyclic group; $R_5$ is a hydrogen atom, a substituted or unsubstituted alkyl group, a substituted or unsubstituted aryl group and a substituted or unsubstituted heterocyclic group; and n and m are each 0, 1, 2 and 3.

13 Claims, 1 Drawing Sheet

ELECTROPHOTOGRAPHIC PHOTOSENSITIVE MEMBER, AND ELECTROPHOTOGRAPHIC APPARATUS, DEVICE UNIT AND FACSIMILE MACHINE EMPLOYING THE PHOTOSENSITIVE MEMBER

BACKGROUND OF THE INVENTION

1. Field of the Invention

The present invention relates to an electrophotographic photosensitive member and, more particularly, to an electrographic layer which contains an acetal resin having a specific structure. The present invention also relates to an electrophotographic apparatus, a device unit and a facsimile machine which employs the electrophotographic photosensitive members.

2. Description of the Related Art

Most known electrophotographic photosensitive members employing organic photoconductive substances have photosensitive layers formed by dispersing charge generating substances of relatively low molecular weights, such as azo pigments or phthalocyuanine pigments, in suitable binder resins. One kind of organic electrophotographic photosensitive member has a so-called laminated-type photosensitive layer comprising two layers: a charge generating layer containing a charge generating substance; and a charge transporting layer containing a charge transporting substance. Such an organic electrophotographic photosensitive member exhibits good sensitivity, potential characteristic and durability, and therefore is widely used.

In such electrophotographic photosensitive members, the characteristics of the photosensitive member are substantially determined by factors such as carrier generating efficiency, carrier transporting efficiency of the photosensitive layer and further, in the laminated type, the efficiency in injecting carriers from the charge generating layer into the charge transporting layer. It is speculated that these factors are affected by the characteristics of a binder resin as well as the characteristics of both charge generating substances and charge transporting substances. However, the primary purpose of the development of the binder resin has been to improve the binding characteristic, the pigment dispersing characteristic and the mechanical strength thereof. Although Japanese Patent Application Laid-Open Nos. 62-30254 and 62-95537 describe that the structure and molecular weight of the binder resin also affect the electrophotographic characteristics such as sensitivity, durability or residual potential of the photosensitive member, they do not clearly describe that a binder resin can serve as a functional resin, and satisfactory electrophotographic characteristics have not been achieved so far.

To meet growing demands for further improving image quality and durability, an electrophotographic photosensitive member having better electrophotographic characteristics must be developed.

SUMMARY OF THE INVENTION

Accordingly, it is an object of the present invention to provide an electrophotographic photosensitive member which has a higher sensitivity, a more stable potential characteristic even after repeated use and, further, a better residual potential characteristic.

It is another object of the present invention to provide an electrophotographic apparatus, a device unit and a facsimile machine which employ the above-mentioned electrophotographic photosensitive members.

To achieve the above objects, the present invention provides an electrophotographic photosensitive member comprising an electroconductive substrate and a photosensitive layer formed thereon, said photosensitive layer containing an acetal resin having a component unit represented by the following formula (1):

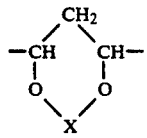

(1)

wherein

X is

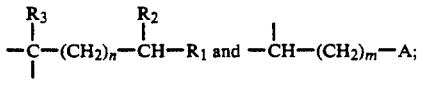

$R_1$ is a substituted or unsubstituted aryl group and a substituted or unsubstituted heterocyclic group;

$R_2$ is a hydrogen atom and a substituted or unsubstituted alkyl group;

$R_3$ is a substituted or unsubstituted alkyl group;

A is a substituted or unsubstituted heterocyclic group and

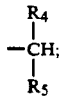

$R_4$ is a substituted or unsubstituted heterocyclic group;

$R_5$ is a hydrogen atom, a substituted or unsubstituted alkyl group, a substituted or unsubstituted aryl group and a substituted or unsubstituted heterocyclic group; and n and m are each 0, 1, 2 and 3.

Further, the present invention provides an electrophotographic apparatus, a device unit and a facsimile machine employing the above-described electrophotographic photosensitive members.

Further objects, features and advantages of the present invention will become apparent from the following description of the preferred embodiments with reference to the attached drawings.

DESCRIPTION OF THE PREFERRED EMBODIMENTS

Figure 1:
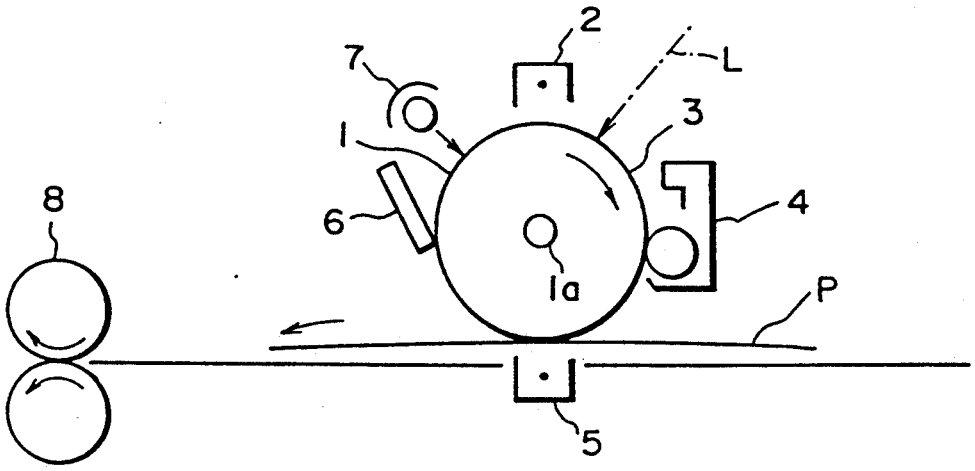
FIG. 1 schematically illustrates the structure of an electrophotographic apparatus employing an electrophotographic photosensitive member according to the present invention.

An electrophotographic photosensitive member according to the present invention has a photosensitive layer which contains an acetal resin having a component unit represented by the following formula (1):

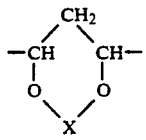

(1)

wherein
X is

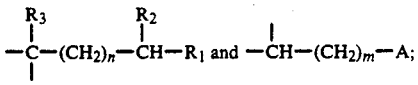

$R_1$ is a substituted or unsubstituted aryl group and a substituted or unsubstituted heterocyclic group;
$R_2$ is a hydrogen atom and a substituted or unsubstituted alkyl group;
$R_3$ is a substituted or unsubstituted alkyl group;
A is a substituted or unsubstituted heterocyclic group and

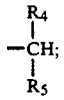

$R_4$ is a substituted or unsubstituted heterocyclic group;
$R_5$ is a hydrogen atom, a substituted or unsubstituted alkyl group, a substituted or unsubstituted aryl group and a substituted or unsubstituted heterocyclic group; and
n and m are each 0, 1, 2 and 3.

More specifically, examples of the aryl group of $R_1$ are: phenyl, styryl, biphenyl, 3-naphtyl, anthryl, phenanthryl, etc., and examples of the heterocyclic group of $R_1$ are: 2-thienyl, 3-thienyl, 2-furyl, 3-furyl, 2-pyrrolyl, 3-pyrrolyl, 2-pyridyl, 3-pyridyl, 4-pyridyl, pyridine-4-oxide-4-yl, piperidino, morpholine, etc. Examples of the alkyl group of $R_2$ and $R_3$ are methyl, etc. Examples of the heterocyclic group of $R_4$ and A are: 2-thienyl, 3-thienyl, 2-furyl, 3-furyl, 2-pyrrolyl, 3-pyrrolyl, 2-pyridyl, 3-pyrridyl, 4-pyridyl, pyridine-4-oxide-4-yl, piperidino, morpholine, etc. Examples of the alkyl group of $R_5$ are: methyl, ethyl, propyl butyl, etc., and examples of the aryl group of $R_5$ are: phenyl, styryl, biphenyl, 3-naphtyl, anthryl, phenanthryl, etc., and the heterocyclic group of $R_5$ may be the same as groups which are allowed for the above groups are: alkyl groups such as methyl, ethyl and propyl; halogen atoms such as fluorine, chlorine,, bromine and iodine; acyl groups such as acetyl and benzoyl, alkoxy groups such as methoxy and ethoxy; aryloxy groups such as phenoxy and tolyloxy; aralkyl groups such as benzyl and naphtylmethyl; arylalkoxy groups such as benzyloxy; alkylamino groups such as dimethylamino and diethylamino; nitro groups; cyano groups; and haloalkyl groups such as trifluoromethyl.

The weight average molecular weight of acetal resin of the present invention should preferably be within a range of 10,000 to 1,000,000, and more preferably, within a range of 100,000 to 500,000. The acetalation degree thereof should preferably be 30 mol % or greater, and more preferably, within a range from 50 to 90 mol %. The residue which is not acetalated may have acetyl groups, propionyl groups, benzoyl groups and amsylcarbonyl groups, as well as hydroxyl groups.

The acetal resin should preferably be made of polyvinyl alcohol, and the saponification degree thereof should preferably be 60 mol % or greater, and more preferably, 85% or greater.

Because the electrophotographic photosensitive member of the present invention comprises a photosensitive layer containing an acetal resin having a specific component unit, the sensitivity, the electric potential stability and residual potential during repeated use are remarkably improved. It is speculated that these advantages are achieved probably because electronic interaction between the acetal resin and charge generating substances improves the carrier generation efficiency and injection efficiency. More specifically, the electronic interaction between the acetal resin and charge generating substances promotes dissociation of carriers and suppresses re-association thereof, thus working favorably for generation of free carriers.

Preferred examples of the component units of an acetal resin according to the present invention are presented below. It should be noted, however, that many other types of component units can also be employed in the present invention.

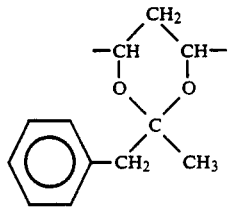

Resin Example 1

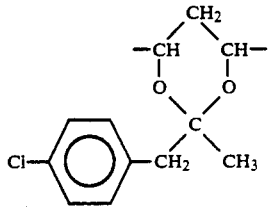

Resin Example 2

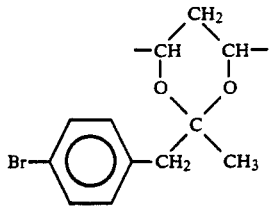

Resin Example 3

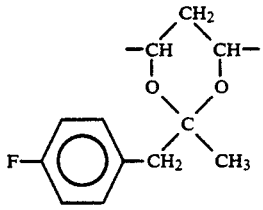

Resin Example 4

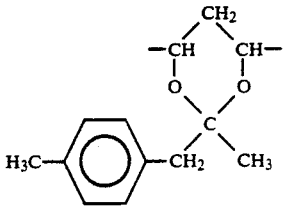

Resin Example 5

-continued
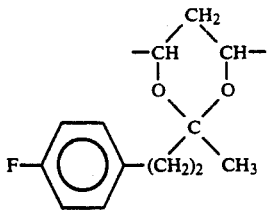
Resin Example 6
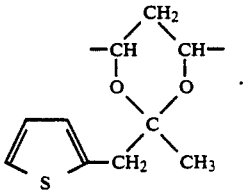
Resin Example 7
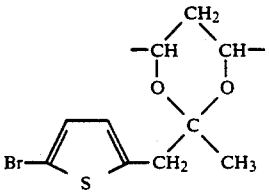
Resin Example 8
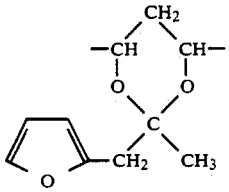
Resin Example 9
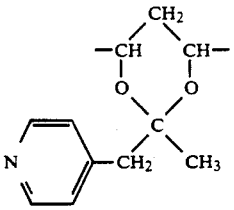
Resin Example 10
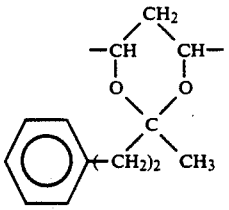
Resin Example 11
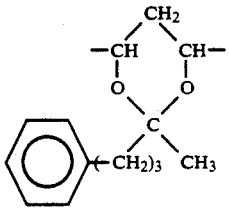
Resin Example 12
-continued
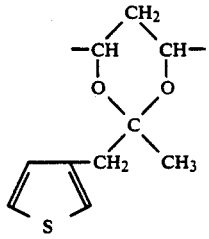
Resin Example 13
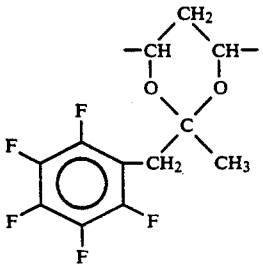
Resin Example 14
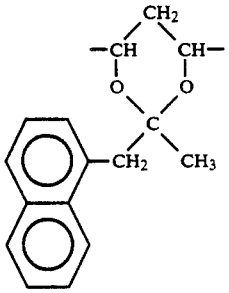
Resin Example 15
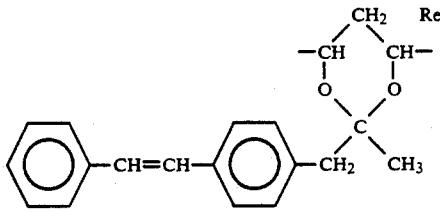
Resin Example 16
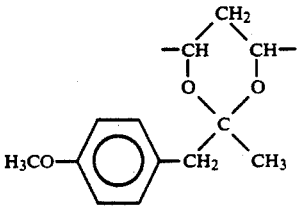
Resin Example 17
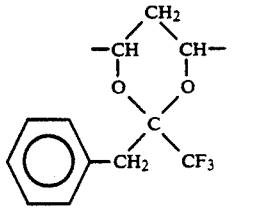
Resin Example 18

-continued
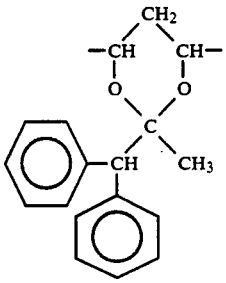
Resin Example 19
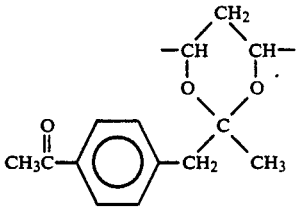
Resin Example 20
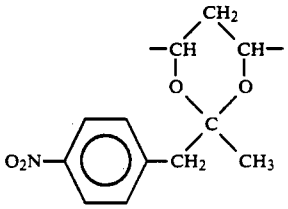
Resin Example 21
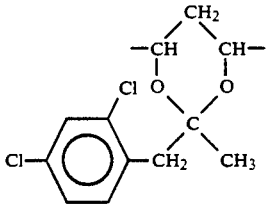
Resin Example 22
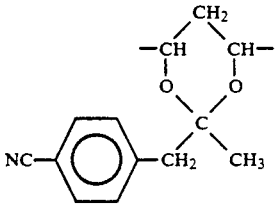
Resin Example 23
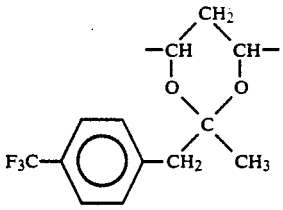
Resin Example 24
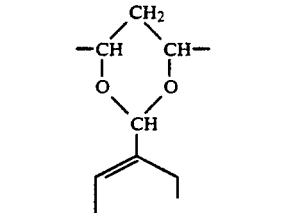
Resin Example 25
-continued
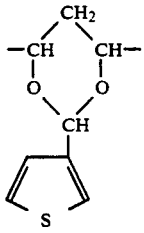
Resin Example 26
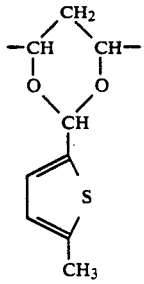
Resin Example 27
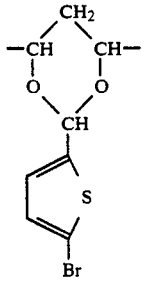
Resin Example 28
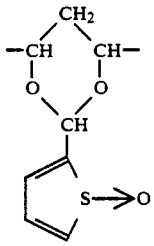
Resin Example 29
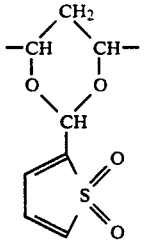
Resin Example 30
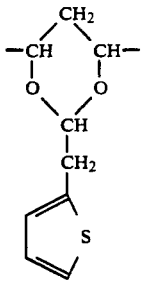
Resin Example 31

-continued
Resin Example 32
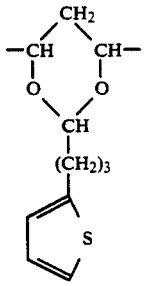
Resin Example 33
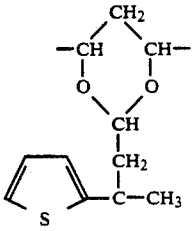
Resin Example 34
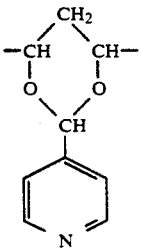
Resin Example 35
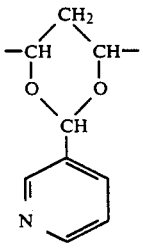
Resin Example 36
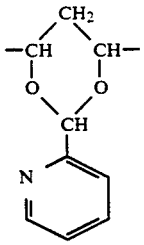
Resin Example 37
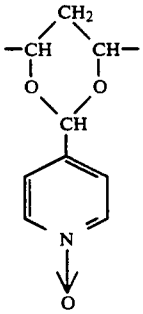
-continued
Resin Example 38
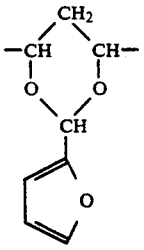
Resin Example 39
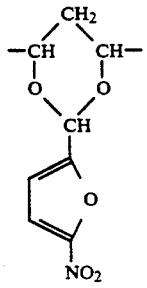
Resin Example 40
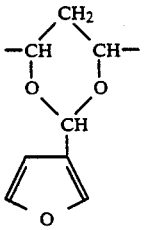
Resin Example 41
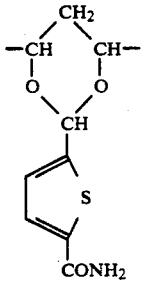
Resin Example 42
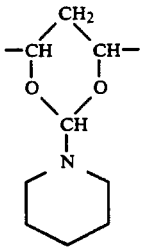
Resin Example 43
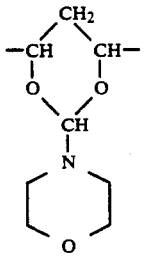

-continued

Resin Example 44

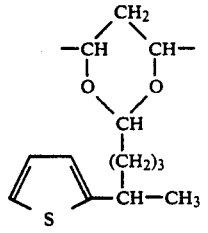

Resin Example 45

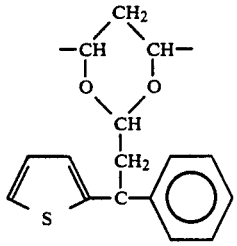

Resin Example 46

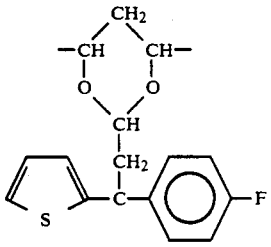

Resin Example 47

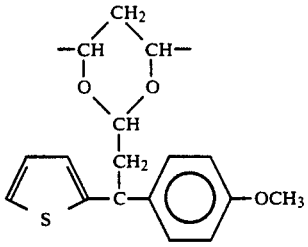

Resin Example 48

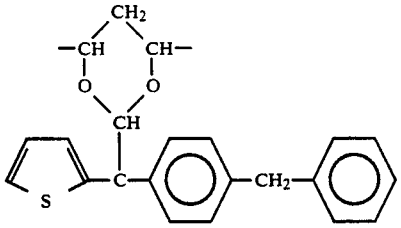

Resin Example 49

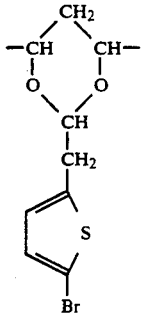

-continued

Resin Example 50

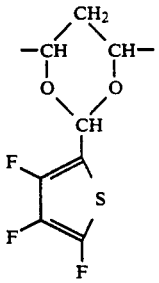

Resin Example 51

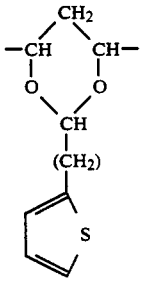

Resin Example 52

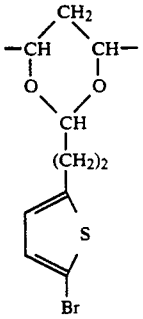

An acetal resin employed in the present invention is synthesized by a known acetalation reaction.

Examples of alcohol ingredients used in this reaction are entirely or partially-saponified polyvinyl alcohols and copolymers of these alcohols and various vinyl compounds, and examples of aldehyde ingredients are corresponding aldehyde and aldehyde acetals, such as dimethylacetal and diethylacetal.

This acetalation reaction progresses in the presence of acidic catalysts in an organic solvent containing the above polyvinyl alcohols and either aldehydes or acetals.

Examples of the organic solvent are: alcohols such as methanol, ethanol, propanol and 2-methoxyethanol; ethers such as tetrahydrofuran and dioxane; aromatic hydrocarbons such as toluene, xylene and chlorobenzene; non-protonic polar solvents such as dimethylsulfoxide, dimethylformamide, N-methylpyrrolidone, sulfolane and acetonitrile; and esters such as ethyl acetate, butyl acetate, methyl benzoate and methylcellosolve acetate. Further, a combination of the above-listed organic solvents or a mixture of an organic solvent in the above list and water may be used.

Examples of the acidic catalyst are: mineral acids such as hydrochloric acid and sulfuric acid; sulfonic acids such as p-toluenesulfonic acid and benzensulfonic acid; zinc chloride; and trifluoroacetic acid. The reaction temperature should preferably be within a range of 20° to 100° C., and more preferably, within a range of 20° to 60° C.

SYNTHESIS EXAMPLE 1 (SYNTHESIS OF RESIN EXAMPLE 1)

3.5 grams of polyvinyl alcohol (having a polymerization degree of 1,000 and a saponification degree of 98.5 mol %, made by Kuraray Co., Ltd.) was suspended in 60 ml of dimethylsulfoxide. 23.2 g of phenylacetone was added to the suspension, and subsequently, 0.4 g of p-toluenesulfonic acid monohydride was added. Then, this suspension was heated and stirred at 40° C. for 6 hours. The resultant solution was added in drops to 2 liters of methanol containing 0.1 g of sodium hydroxide, and thereby the polyvinyl acetal was deposited. The polyvinyl acetal was filtered out and dissolved into 50 ml of N,N-dimethylformaldehyde. Insoluble materials were filtered out. The filtrate was added in drops to 2 liters of methanol, and thereby the polymer was deposited. The polymer was filtered out and then dried. 4.9 g of the polyvinyl acetal, Resin Example 1, was thus obtained. The acetalation degree of this polymer was 61.5 mol %, measured by a method according to Japanese Industrial Standard K6728 (polyvinyl butyral test method).

SYNTHESIS EXAMPLE 2 (SYNTHESIS OF RESIN EXAMPLE 25)

3.5 g of polyvinyl alcohol (having a polymerization degree of 1,000 and a saponification degree of 98.5 mol %, made by Kuraray Co., Ltd.) was suspended in 60 ml of dimethylsulfoxide. 17.8 g of 2-thiophenaldehyde was added to the suspension, and subsequently, 0.4 g of p-toluenesulfonic acid monohydrate was added. Then, this suspension was heated and stirred at 40° C. for 6 hours. The resultant solution was added in drops to 2 liters of methanol containing 0.1 g of sodium hydroxide, and thereby the polyvinyl acetal was deposited. The polyvinyl acetal was filtered out and dissolved into 50 ml of tetrahydrofuran. Insoluble materials were filtered out. The filtrate was added in drops to 2 liters of methanol, and thereby the polymer was deposited. The polymer was filtered out and then dried. 5.8 g of the polyvinyl acetal, Resin Example 25, was thus obtained. The acetalation degree of this polymer was 70 mol %, measured by a method according to Japanese Industrial Standard K6728 (polyvinyl butyral test method).

The photosensitive layer of the electrophotographic photosensitive member of the present invention may be either a laminated type which is composed of functionally different layers: a charge generating layer containing a charge generating substance; and a charge transporting layer containing a charge transporting substance, or a monolayer type which is composed of a single layer containing a charge generating substance and a charge transporting substance. However, a laminated type photosensitive layer is more preferably. In the case of the laminated type, the above-described polyvinyl acetal should preferably be contained in the charge generating layer.

According to the present invention, the photosensitive layer should preferably contain the above-described polyvinyl acetal 10 to 90%, and more preferably, 20 to 50%, by weight with respect to the total weight of the layer containing the polyvinyl acetal.

An acetal resin according to the present invention may used together with other polymers. Examples of the other polymers are: resins such as polyvinyl butyral, polyvinyl benzal, polyarylate, polycarbonate, polyester, phenoxy resin, acrylic resin, polyacrylamide, polyamide, polyurethane, polystyrene and acrylonitrile-styrene copolymer; and organic photoconductive polymers such as poly-N-vinylcarbazole or polyvinyl anthracene.

Examples of the charge generating substances are: azo-type pigments such as mono azo, bis-azo and tri-azo; phthalocyanine-type pigments such as metal phthalocyanine and metal-free phthalocyanine; indigo-type pigments such as indigo and thioindigo; polycyclic quinone-type pigments such as anthanthrone and pyrenequinone; perylene-type pigments such as perylenic acid anhydride and perylenic acid imide; squarilium-type dye; pyrylium; thiapyrylium; and triphenylmethane-type pigments.

Charge transporting substances fall into two groups: electron transporting substances, and positive hole transporting substances. According to the present invention, examples of the electron transporting substances are electron receiving substances, such as 2,4,7-trinitrofluorene, 2,4,5,7-tetranitrofluorene, chloranil and tetracyanoquinodimethane, and high molecular substances having these electron receiving substances as their components. Examples of the positive hole transporting substances are: polycyclic aromatic compounds such as pyrene and anthracene; heterocyclic compounds such as compounds of carbazole, indole, imidazole, oxazole, thiazole, oxadiazole, pyrazole, pyrazoline, thiadiazole and triazole; hydrazone compounds such as p-diethylaminobenzaldehyde-N,N-diphenylhydrazone, and N,N-diphenylhydrazino-3-methylidene-9-ethyl carbazole; styryl compounds such as α-phenyl-4'-N,N-diphenylaminostilbene and 5-[4-(di-p-tolylamino) benzylidene]-5H-dibenzo [a,d] cycloheptene; benzidine compounds; triarylmethane compounds; triphenylamine compounds; and polymers, such as poly-N-vinylcarbazole or polyvinylanthracene, having a group composed of an above-listed compound in the main or side chains.

When the charge transporting substance itself does not have any film-forming nature, the charge transporting layer can be formed with the aid of a binder resin. More specifically, it is possible to use an insulating resin such as an acrylic resin, polyarylate, polyester, polycarbonate, polystyrene, acrylonitrile-styrene copolymer, polyacrylamide, polyamide or chlorinated rubber, as well as an organic photoconductive polymer such as poly-N-vinylcarbazole and polyvinyl anthracene.

Examples of the solvent which is used to form a photosensitive layer containing an acetal resin according to the present invention are: ethers such as tetrahydrofuran and 1,4-dioxane; ketones such as cyclohexanone, methylethylketone and 2-methoxy-2-methyl-4-pentanone; amides such as N,N-dimethylformamide; esters such as ethyl acetate and butyl acetate; aromatic compounds such as toluene, xylene and chlorobenzene; alcohols such as methanol and ethanol; and aliphatic hydrocarbon halides such a methylene chloride.

The charge generating layer of a laminated-type photosensitive layer should preferably have a thickness of 5 μm or less, and more preferably, within a range of 0.01 to 1 μm. The charge transporting layer is laminated on top of or under the charge generating layer. The thickness of the charge transporting layer should preferably be within a range of 5 to 40 μm, and more preferably, within a range of 15 to 30 μm. A monolayer-type photosensitive layer should preferably have a thickness within a range of 1 to 40 μm, and more preferably, within a range of 10 to 30 μm.

Examples of a material for an electroconductive substrate according to the present invention are: aluminum, an aluminum alloy, copper, zinc, stainless steel, vanadium, molybdenum, chromium, titanium, nickel, indium, gold and platinum. The electroconductive substrate also may be formed by plastic (e.g., polyethylene, polypropylene, polyvinyl chloride, polyethylene terephthalate or an acrylic resin) coated with any one of the above-listed metals or alloy by vacuum deposition, a plastic or metallic plate coated with conductive particles (e.g., carbon black or silver particles) and a suitable binder resin. Still further, the conductive particles may be held in a plastic or paper material to form the substrate.

The electroconductive substrate should be in the shape which is most suitable to the electrophotographic apparatus which employs the photosensitive member, for example, the shape of a drum, sheet or belt.

According to the present invention, an undercoating layer which serves as a barrier and an adhesive may be formed between the electroconductive substrate and the photosensitive layer. The undercoating layer may be formed of any of the following: casein, polyvinyl alcohol, nitrocellulose, polyamides (nylon 6, nylon 66, nylon 610, copolymerized nylon or nylon alkoxymethylate), polyurethane or aluminum oxide. The thickness of the undercoating layer should preferably be 5 μm or less, and more preferably, within a range of 0.1 to 3 μm.

Further, according to the present invention, a resin layer or a resin layer containing conductive particles may be laminated on top of the photosensitive layer for protection thereof.

The above-described layers may be formed by a desired application method such as dip coating, spinner coating, bead coating, blade coating, spray coating or beam coating.

The electrophotographic photosensitive member of the present invention can be applied to not only electrophotographic copying machines but also a wide variety of other electrophotographic equipment such as laser printers, CRT printers, LED printers, liquid crystal printers, laser plate making systems or facsimiles.

FIG. 1 schematically illustrates the structure of an embodiment of the electrophotographic apparatus of the present invention which employs an electrophotographic photosensitive member of the present invention.

Referring to FIG. 1, a drum-shape photosensitive member 1 for carrying an image is rotated about a shaft 1*a* in the direction of an arrow at a predetermined rotational speed. While the photosensitive member 1 is rotating, the peripheral surface of the photosensitive member 1 is uniformly charged with a predetermined level of positive or negative electric potential by charging means 2 and subsequently subjected to image light exposure L (e.g., slit light exposure or laser beam scanning exposure) at an exposure region 3 by exposure means (not shown). Thus, an electrostatic latent image is continuously formed on the peripheral surface of the photosensitive member 1, corresponding to the exposure image.

The thus-formed electrostatic latent image is toner-developed by developing means 4. The toner-developed image is subsequently transferred by transferring means 5 onto a transfer material P, which is fed from a feeding unit (not shown) into a gap between the photosensitive member 1 and the transferring means 5 synchronously with rotation of the photosensitive member 1.

After receiving the transferred image, the transfer material P is separated from the surface of the photosensitive member 1 and led to image fixing means 8, which then fixes the image. Then, the transfer material P is discharged, carrying a copy image thereon.

After the image transfer, the surface of the photosensitive member 1 is cleaned by cleaning means 6, which removes remaining toner from the surface. Then, the surface is discharged by pre-exposure treatment means 7. The photosensitive member 1 is thus repeatedly used for image forming.

One of the most widely-used charging means 2 for uniformly charging the photosensitive member 1 is a corona electrical charging device. One of the most widely-used transferring means 5 is a corona electrical transferring device. According to the present invention, two or more component units of the above-described photosensitive member, developing means, cleaning means, etc., may be assembled into a device unit which is detachable from the main body of the apparatus. For example, a photosensitive member is combined with at least one of charging means, developing means or cleaning means to form a device unit separate from the apparatus main body, and guide means, such as a rail in the main body, is provided for detachably incorporating the device unit into the main body. The device unit may further comprise charging means and/or developing means.

In the case where the electrophotographic apparatus of the present invention is used as a copying machine or a printer, light image exposure L is performed by irradiating the photosensitive member with light reflected from or transmitted through an original image, or by irradiating the photosensitive member by means of laser beam scanning, LED array driving or liquid crystal shutter array driving in accordance with signals from a sensor which reads an original image.

Figure 2:
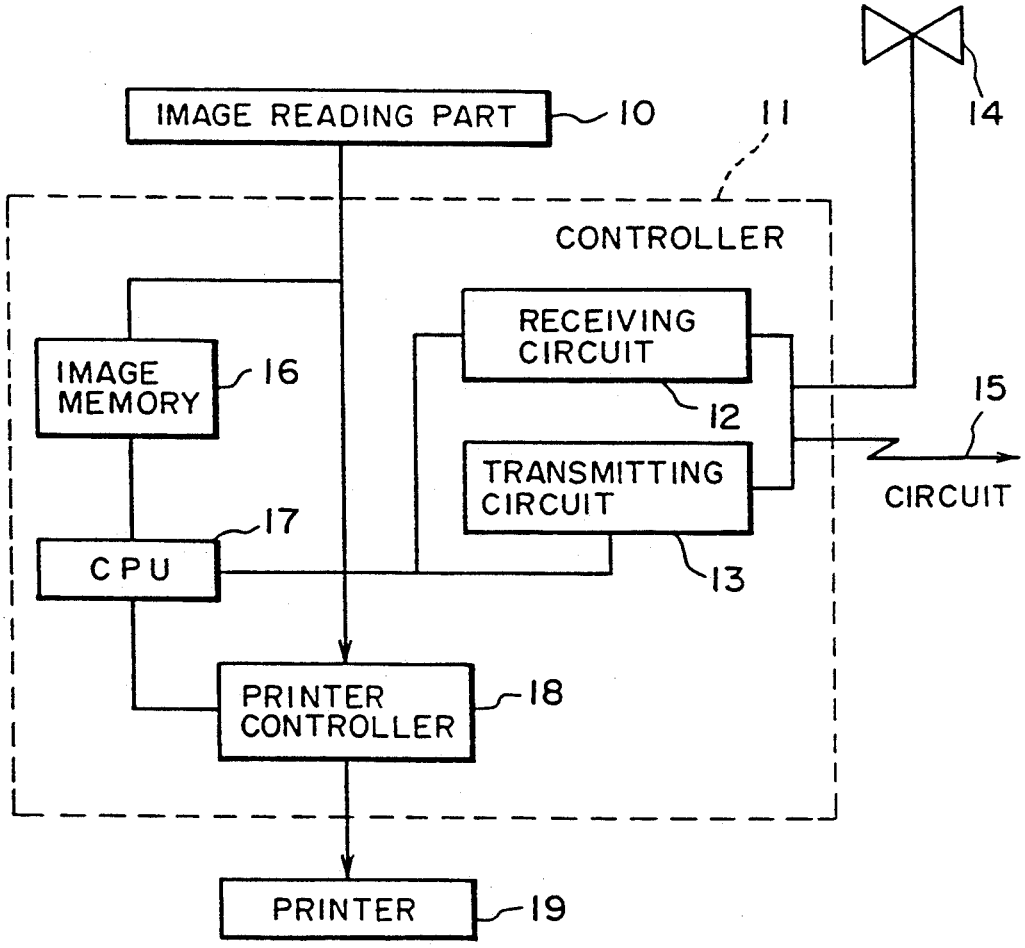
FIG. 2 is a block diagram of a facsimile machine employing an electrophotographic photosensitive member according to the present invention.

In the case where the electrophotographic apparatus of the present invention is used as the printer of a facsimile machine, light image exposure L is performed in order to print according to data received form the outside. FIG. 2 is a block diagram of such a facsimile machine.

Referring to FIG. 2, a controller 11 controls an image reading part 10 and a printer 19. The entire system of the controller 11 is controlled by a CPU 17. Data read by the image reading part 10 is transmitted through a transmitting circuit 13 to a communication partner apparatus. Data received from a communication partner apparatus is sent through a receiving circuit 12 to the printer 19. An image memory 16 stores designated image data. A printer controller 18 controls the printer 19. Reference numeral 14 denotes a telephone.

Image received through a line 15 (or image data received from a remote terminal connected to the other end of the line 15) is demodulated by the receiving circuit 12, decoded by the CPU 17 and then sequentially stored in the image memory 16. When at least one page of decoded image data is stored in the memory 16, the image data of the page is printed as follows. The CPU 17 reads out the decoded image data of the page from the memory 16 and sends the decoded image data to the printer controller 18. When receiving the image data of the page from the CPU 17, the printer controller 18 controls the printer 19 so that the printer prints out the image of the page.

While the printer 19 is performing printing, the CPU 17 receives image data of the next page.

The facsimile thus receives image data and prints out the image.

EXAMPLE 1

5 g of nylon methoxymethylate (number average molecular weight of 32,000) and 10 g of alcohol-soluble copolymerized nylon (number average molecular weight of 29,000) were dissolved into 95 g of methanol. The obtained solution was applied to an aluminum substrate by using a wire bar and then dried. An undercoating layer having a thickness of 1 μm was thus formed.

90 g of cyclohexanone was added to 5 g of bis-azo pigment represented by the following formula:

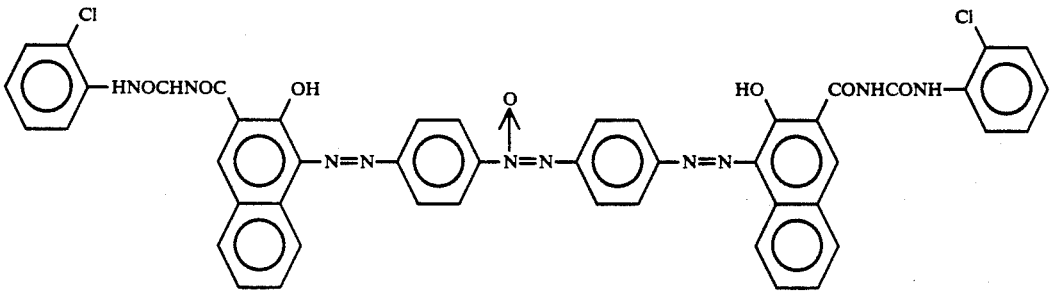

The pigment was dispersed in cyclohexanone for 20 hours by a sand mill. Then, a solution prepared by dissolving 2.5 g of polyvinyl acetal of Resin Example 1 into 20 g of cyclohexanone was added to the pigment-dispersed solution. The mixture was further dispersed for 2 hours. The resulting dispersed solution was diluted by adding 200 g of methylethylketone. The diluted solution was applied onto the undercoating layer to a thickness of 0.2 μm by using a wire bar, thus forming a charge generating layer.

Next, 5 g of a triarylamine compound represented by the following formula:

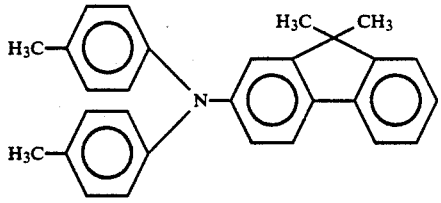

and 5 g of polycarbonate (number average molecular weight of 55,000) were dissolved into 40 g of chlorobenzene. The obtained solution was applied onto the charge generating layer by using a wire bar so as to form a charge transporting layer having a thickness of 20 μm.

For evaluation of the charging characteristic of the thus-produced electrophotographic photosensitive member, the member was negatively charged by corona discharging of −5 KV by using an electrostatic copying paper testing apparatus Model SP-428 made by Kawaguchi Kabushiki Kaisha, let to stand for one second in a dark place and then exposed to an illumination intensity of 10 lux by using a halogen lamp. A surface potential ($V_O$), an exposure ($E_{\frac{1}{2}}$) required to attenuate the surface potential after standing for one second (dark potential: $V_D$) to ½ and a residual potential ($V_r$) were measured to evaluate the charging characteristics of the member.

The results are shown in Table 1.

EXAMPLES 2 TO 5

Electrophotographic photosensitive members were produced and evaluated by the same manner as those in Example 1, except that the pigments shown in Table 1 were used.

The results are shown in Table 1.

EXAMPLES 6 TO 10

Electrophotographic photosensitive members were produced in the same manner as those in Example 1, except that the acetal resin shown in Table 1 was used, that tetrahydrofuran was used instead of cyclohexanone, and that a 1:1 (by weight) mixture solvent of tetrahydrofuran and cyclohexanone was used instead of methylethylketone. The obtained photosensitive members were evaluated in the same manners as those in Example 1.

The results are shown in Table 1.

TABLE 1

| Example | Resin Example | $V_o$ (−V) | $E_{\frac{1}{2}}$ (lux · sec) | $V_r$ (−V) |
|---|---|---|---|---|
| 1 | 1 | 707 | 1.11 | 0 |
| 2 | 4 | 705 | 1.05 | 0 |
| 3 | 6 | 703 | 1.13 | 0 |
| 4 | 8 | 700 | 1.25 | 0 |
| 5 | 24 | 701 | 1.32 | 0 |
| 6 | 25 | 708 | 1.38 | 0 |
| 7 | 26 | 710 | 1.34 | 0 |
| 8 | 28 | 710 | 1.00 | 0 |
| 9 | 39 | 703 | 1.28 | 0 |
| 10 | 52 | 702 | 1.03 | 0 |

EXAMPLE 11

An electrophotographic photosensitive member was produced in the same manner as those in Example 1, except that the polyvinyl acetal of Resin Example 4 and a bis-azo pigment represented by the following formula:

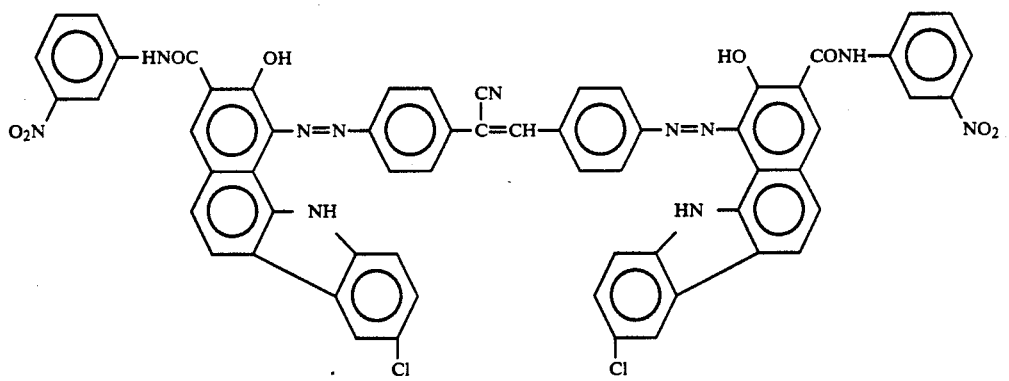

were used instead. The charging characteristic of the obtained photosensitive member was evaluated in the same manner as those in the above examples.

The results were as follows: $V_O$, −700 V; $E_{\frac{1}{2}}$, 1.39 lux·sec; and $V_r$ 0 V.

EXAMPLE 12

An electrophotographic photosensitive member was produced in the same manner as those in Example 6, except that the polyvinyl acetal of Resin Example 28 and the same bis-azo pigment as used in Example 11 were used instead. The charging characteristic of the obtained photosensitive member was evaluated in the same manner as in the above examples.

The results were as follows: $V_O$, −700 V; $E_{\frac{1}{2}}$, 1.56 lux·sec; and $V_r$, 0 V.

EXAMPLE 13

An electrophotographic photosensitive member was produced in the same manner as those n Example 1, except that cyclohexanone as a dispersion solvent was used, that methylethylketone as a dilution solvent was used, that a bis-azo pigment represented by the following formula:

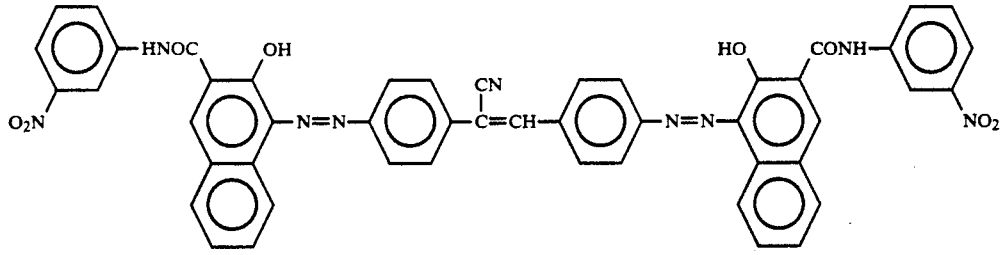

was used and that a styryl compound represented by the following formula:

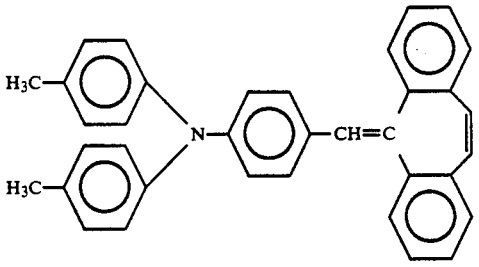

was used instead of the triarylamine compound as a charge transporting substance. The charging characteristic of the obtained photosensitive member was evaluated in the same manner as those in the above examples.

The results were as follows: $V_O$, −700 V; $E_{\frac{1}{2}}$, 1.01 lux·sec; and $V_r$, 0 V.

EXAMPLE 14

An electrophotographic photosensitive member was produced in the same manner as those in Example 6, except that the same bis-azo pigment, dispersion solvent and charge transporting substance as used in Example 13 were used instead. The charging characteristic of the obtained photosensitive member was evaluated in the same manner as those in the above examples.

The results were as follows: $V_O$, −700 V; $E_{\frac{1}{2}}$, 1.95 lux·sec; and $V_r$, 0 V.

EXAMPLE 15

An electrophotographic photosensitive member was produced in the same manner as those in Example 1, except that a dispersion solution, prepared by adding 350 g of tetrahydrofuran to 10 g of a metal-free phthalocyanine, mixing the obtained solution with a solution prepared by dissolving 5 g of the polyvinyl acetal of Resin Example 4 into 50 g of tetrahydrofuran, and dispersing the mixture by using a sand mill for 10 hours, was used instead in order to form a charge generating layer. The charging characteristic of the obtained photosensitive member was evaluated in the same manner as those in the above examples.

The results were as follows: $V_O$, −700 V; $E_{\frac{1}{2}}$, 1.23 lux·sec; and $V_r$, −15 V.

EXAMPLE 16

An electrophotographic photosensitive member was produced in the same manner as those in Example 15, except that the polyvinyl acetal of Resin Example 28 was used instead. The charging characteristic of the obtained photosensitive member was evaluated in the same manner as those in the above examples.

The results were as follows: $V_O$, −700 V; $E_{\frac{1}{2}}$, 1.13 lux·sec; and $V_r$, −5 V.

EXAMPLE 17

An electrophotographic photosensitive member was produced in the same manner as those in Example 15, except that copper phthalocyanine was used instead of the metal-free phthalocyanine. The charging characteristic of the obtained photosensitive member was evaluated in the same manner as those in the above examples.

The results were as follows: $V_O$, −700 V; $E_{\frac{1}{2}}$, 1.28 lux·sec; and $V_r$, −10 V.

EXAMPLE 18

An electrophotographic photosensitive member was produced in the same manner as those in Example 16, except that copper phthalocyanine was used instead of the metal-free phthalocyanine. The charging characteristic of the obtained photosensitive member was evaluated in the same manner as those in the above examples.

The results were as follows: $V_O$, −700 V; $E_{\frac{1}{2}}$, 1.35 lux·sec; and $V_r$, −5 V.

COMPARATIVE EXAMPLES 1, 2 AND 3

Electrophotographic photosensitive members were produced in the same manner as those in Example 1, except that polyvinyl acetals (acetalation degrees of 75 to 80 mol %) having structures as shown in Table 2 was used instead of the polyvinyl acetal of Resin Example 1. The charging characteristic of the obtained photosensitive member was evaluated by the same method as in the above examples.

The results are shown in Table 2.

TABLE 2

| | Structure of Resin | $V_o$ (−V) | $E_{\frac{1}{2}}$ (lux · sec) | $V_r$ (−V) |
|---|---|---|---|---|
| Comparative Example 1 | 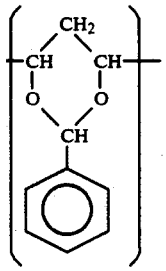 | 695 | 2.95 | 5 |

TABLE 2-continued

| | Structure of Resin | $V_o$ (−V) | $E_{\frac{1}{2}}$ (lux · sec) | $V_r$ (−V) |
|---|---|---|---|---|
| Comparative Example 2 | 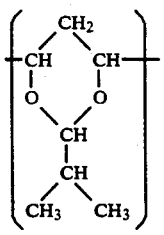 | 710 | 3.25 | 5 |
| Comparative Example 3 | 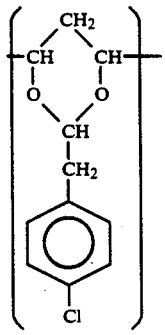 | 700 | 1.90 | 10 |

EXAMPLE 19

An electrophotographic photosensitive member was produced as follows: 4 g of the bis-azo pigment as used in Example 1 was added with 90 g of cyclohexanone and dispersed for 20 hours by a sand mill. The dispersed solution was added with a solution prepared by dissolving 20 g of the polyvinyl acetal of Resin Example 4 into 300 g of tetrahydrofuran, and shaken for 2 hours. The solution was then mixed with a solution prepared by dissolving 40 g of the triarylamine compound as used in Example 1 and 20 g of the polyvinyl acetal of Resin Example 4 into 200 g of tetrahydrofuran, and the mixture was again shaken. The thus prepared solution was applied to an aluminum substrate by using a wire bar so as to form a photosensitive layer having a thickness of 20 μm, thus obtaining an electrophotographic photosensitive member. The charging characteristic of this electrophotographic photosensitive member was evaluated in the same manner in Example 1, except that the member was positively charged and that no residual potential $V_r$ was measured in Example 19.

The results were as follows: +675 V; and $E_{\frac{1}{2}}$, 2.53 lux·sec.

EXAMPLE 20

An electrophotographic photosensitive member was produced in the same manner as those in Example 19, except that the polyvinyl acetal of Resin Example 25 was used instead. The charging characteristic of the obtained photosensitive member was evaluated in the same manner as those in Example 19.

The results were as follows: $V_O$, +650 v; and $E_{\frac{1}{2}}$, 2.31 lux·sec.

EXAMPLES 21 TO 26

The electrophotographic photosensitive members produced in Examples 2, 4, 5, 7, 8 and 9 were attached to cylinders of electrophotographic copying machines each comprising: a corona charging unit of −6.5 KV, an exposure optical system, a developing unit, a transfer charging unit, a discharging exposure optical system, and a cleaner. The initial levels of the dark potential $V_D$ and the light potential $V_L$ were set at about −700 V and −200 V, respectively. The initial potentials $V_D$, $V_L$ and the potentials $V_D$, $V_L$ after being repeatedly used 5,000 times were measured. The amount of variation in the dark potential ($\Delta V_D$) and the amount of variation in the light potential ($\Delta V_L$) were obtained to evaluate the durability characteristics of the photosensitive members.

The results are shown in Table 3. In Table 3, the negative values of the amount of potential variation mean that the absolute values of potentials decreased, and the positive values thereof mean that the absolute values of potentials increased.

COMPARATIVE EXAMPLES 4, 5 AND 6

The durability characteristics of the electrophotographic photosensitive members produced in Comparative Examples 1, 2 and 3 were evaluated in the same manner as those in Example 21.

The results are shown in Table 3.

TABLE 3

| | $\Delta V_D$(V) | $\Delta V_L$(V) |
|---|---|---|
| Example | | |
| 21 | 0 | +5 |
| 22 | +5 | 0 |
| 23 | 0 | +10 |
| 24 | −5 | 0 |
| 25 | +5 | 0 |
| 26 | 0 | 0 |
| Comparative Example | | |
| 4 | −30 | +20 |
| 5 | −20 | +25 |
| 6 | −50 | +20 |

EXAMPLE 27

An electrophotographic photosensitive member was produced in the same manner as those in Example 2, except that a charge generating layer was disposed on a charge transporting layer. The charging characteristic of the obtained photosensitive member was evaluated in the same manners as those in Example 1, except that the member was positively charged and no residual potential $V_r$ was measured.

The results were as follows: $V_O$, +700 V; and $E_{\frac{1}{2}}$, 1.85 lux·sec.

EXAMPLE 28

An electrophotographic photosensitive member was produced in the same manner as those in Example 6, except that a charge generating layer was disposed on a charge transporting layer. The charging characteristic of the obtained photosensitive member was evaluated in the same manner as those in Example 1, except that the member was positively charged and that no residual potential $V_r$ was measured.

The results were as follows: $V_O$, +710 V; and $E_{\frac{1}{2}}$, 1.78 lux·sec.

EXAMPLE 29

An electrophotographic photosensitive member was produced in the same manner as those in Example 1, except that a solution prepared by dissolving 5 g of 2,4,5-trinitro-9-fluorenone and 5 g of polycarbonate (number average molecular weight of 30,000) into 50 g of tetrahydrofuran was used instead in order to form a charge transporting layer. The charging characteristic of the obtained photosensitive member was evaluated in the same manner as those in Example 1, except that the member was positively charged and no residual potential $V_r$ was measured.

The results were as follows; $V_O$, +710 V; and $E_{\frac{1}{2}}$, 2.50 lux·sec.

EXAMPLE 30

An electrophotographic photosensitive member was produced in the same manner as those in Example 6, except that a solution prepared by dissolving 5 g of 2,4,5-trinitro-9-fluorenone and 5 g of polycarbonate (number average molecular weight of 30,000) into 50 g of tetrahydrofuran was used instead in order to form a charge transporting layer. The charging characteristic of the obtained photosensitive member was evaluated in the same manner as those in Example 6, except that the member was positively charged and that no residual potential $V_r$ was measured.

The results were as follows: $V_O$, 690 v; and $E_{\frac{1}{2}}$, 2.67 lux·sec.

As understood from the above description, because the electrophotographic photosensitive member employs specific polyvinyl acetals as a binder resin in the photosensitive layer, it achieves good sensitivity, potential stability and low residual potential in repeated use. Accordingly, an electrophotographic apparatus, a device unit and a facsimile machine employing such electrophotographic photosensitive member achieve substantially the same advantages.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electrophotographic photosensitive member comprising an electroconductive substrate and a photosensitive layer formed thereon, said photosensitive layer containing an acetal resin having a component unit represented by the following formula (1):

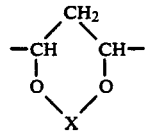

(1)

wherein

X is

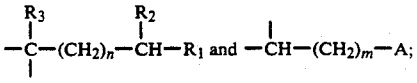

$R_1$ is a substituted or unsubstituted aryl group and a substituted or unsubstituted heterocyclic group;

$R_2$ is a hydrogen atom and a substituted or unsubstituted alkyl group;

$R_3$ is a substituted or unsubstituted alkyl group;

A is a substituted or unsubstituted heterocyclic group and

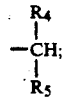

$R_4$ is a substituted or unsubstituted heterocyclic group;

$R_5$ is a hydrogen atom, a substituted or unsubstituted alkyl group, a substituted or unsubstituted aryl group and a substituted or unsubstituted heterocyclic group; and n and m are each 0, 1, 2 and 3.

2. An electrophotographic photosensitive member according to claim 1, wherein X (1) is:

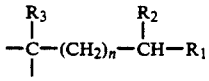

wherein $R_1$, $R_2$, $R_3$ and n are the same as in formula (1).

3. An electrophotographic photosensitive member according to claim 1, wherein X (1) is:

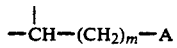

wherein A and m are the same as in formula (1).

4. An electrophotographic photosensitive member according to claim 1, wherein said photosensitive layer has a charge generating layer and a charge transporting layer.

5. An electrophotographic photosensitive member according to claim 4, wherein said charge generating layer contains an acetal resin having a component unit represented by said formula (1).

6. An electrophotographic photosensitive member according to claim 4, wherein said charge generating layer is disposed on said electroconductive substrate and said charge transporting layer is disposed on said charge generating layer.

7. An electrophotographic photosensitive member according to claim 4, wherein said charge transporting layer is disposed on said electroconductive substrate and said charge generating layer is disposed on said charge transporting layer.

8. An electrophotographic photosensitive member according to claim 1, wherein said photosensitive layer is a single layer.

9. An electrophotographic photosensitive member according to claim 1, further comprising an undercoating layer between said electroconductive substrate and said photosensitive layer.

10. An electrophotographic photosensitive member according to claim 1, further comprising a protective layer overlying said photosensitive layer.

11. An electrophotographic apparatus comprising: an electrophotographic photosensitive member; electrostatic latent image forming means for forming an electrostatic latent image on said electrophotographic photosensitive member; developing means for developing the formed electrostatic latent image; and transfer means for transferring the developed image onto a transfer medium, said electrophotographic photosensitive member comprising an electroconductive substrate and a photosensitive layer formed thereon, said photosensitive layer containing an acetal resin having a component unit represented by the following formula (1):

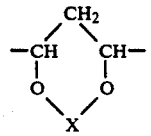

(1)

wherein

X is

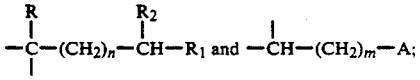

$R_1$ is a substituted or unsubstituted aryl group and a substituted or unsubstituted heterocyclic group;

$R_2$ is a hydrogen atom and a substituted or unsubstituted alkyl group;

$R_3$ is a substituted or unsubstituted alkyl group;

A is a substituted or unsubstituted heterocyclic group and

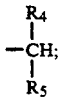

$R_4$ is a substituted or unsubstituted heterocyclic group;

$R_5$ is a hydrogen atom, a substituted or unsubstituted alkyl group, a substituted or unsubstituted aryl group and a substituted or unsubstituted heterocyclic group; and n and m are each 0, 1, 2 and 3.

12. A device unit comprising an electrophotographic photosensitive member and means selected from the group consisting of charging means, developing means and cleaning means, said electrophotographic photosensitive member comprising an electroconductive substrate and a photosensitive layer formed thereon, said photosensitive layer containing an acetal resin having a component unit represented by the following formula (1):

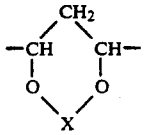

(1)

wherein

X is

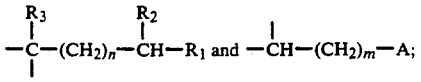

$R_1$ is a substituted or unsubstituted aryl group and a substituted or unsubstituted heterocyclic group;

$R_2$ is a hydrogen atom and a substituted or unsubstituted alkyl group;

$R_3$ is a substituted or unsubstituted alkyl group;

A is a substituted or unsubstituted heterocyclic group and

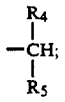

$R_4$ is a substituted or unsubstituted heterocyclic group;

$R_5$ is a hydrogen atom, a substituted or unsubstituted alkyl group, a substituted or unsubstituted aryl group and a substituted or unsubstituted heterocyclic group;

n and m are each 0, 1, 2 and 3; and said electrophotographic photosensitive member and means selected from the group consisting of charging means, developing means and cleaning means being assembled together to form said device unit which is detachable from the main body of an electrophotographic apparatus.

13. A facsimile machine comprising: an electrophotographic apparatus, and receiving means for receiving image data from a remote terminal, said electrophotographic apparatus having an electrophotographic photosensitive member comprising an electroconductive substrate and a photosensitive layer formed thereon, said photosensitive layer containing an acetal resin having a component unit represented by the following formula (1):

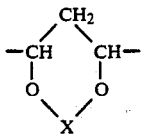

(1)

wherein

X is

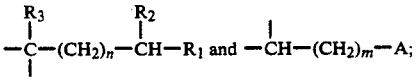

$R_2$ is a substituted or unsubstituted aryl group and a substituted or unsubstituted heterocyclic group;

$R_2$ is a hydrogen atom and a substituted or unsubstituted alkyl group;

$R_3$ is a substituted or unsubstituted alkyl group;

A is a substituted or unsubstituted heterocyclic group and

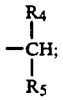

$R_4$ is a substituted or unsubstituted heterocyclic group;

$R_5$ is a hydrogen atom, a substituted or unsubstituted alkyl group, a substituted or unsubstituted aryl group and a substituted or unsubstituted heterocyclic group; and n and m are each 0, 1, 2 and 3.

* * * * *

UNITED STATES PATENT AND TRADEMARK OFFICE

CERTIFICATE OF CORRECTION

PATENT NO. : 5,288,575

DATED : February 22, 1994

INVENTOR(S) : YOSHIO KASHIZAKI, ET AL.

It is certified that error appears in the above-indentified patent and that said Letters Patent is hereby corrected as shown below:

COLUMN 1

Line 12, "electrographic layer" should read --electrophotographic photosensitive member having a photosensitive layer--.
Line 22, "phthalocyuanine" should read --phthalocyanine--.

COLUMN 3

Line 49, "as groups" should read --as mentioned in connection with $R_4$. Examples of the substitution groups--.
Line 53, "benzoyl," should read --benzoyl;--.
Line 68, "amsylcarbonyl" should read --anisylcarbonyl--.

COLUMN 13

Line 55, "preferably." should read --preferable.--.
Line 65, "may" should read --may be--.

COLUMN 18

Line 45, "manners" should read --manner--.

COLUMN 19

Line 37, "n" should read --in--.

COLUMN 22

Line 48, "manner" should read --manner as--.

UNITED STATES PATENT AND TRADEMARK OFFICE

CERTIFICATE OF CORRECTION

PATENT NO. : 5,288,575

DATED : February 22, 1994

INVENTOR(S) : YOSHIO KASHIZAKI, ET AL.

It is certified that error appears in the above-indentified patent and that said Letters Patent is hereby corrected as shown below:

COLUMN 23

Line 10, "obtained" should read --obtained for each--.
Line 45, "manners" should read --manner--.

COLUMN 25

Line 20, "X (1)" should read --X--.
Line 29, "X (1)" should read --X--.

Signed and Sealed this

Twenty-third Day of August, 1994

Bruce Lehman

*Attest:*

BRUCE LEHMAN

*Attesting Officer*

*Commissioner of Patents and Trademarks*